US009625219B2

(12) United States Patent
Takagi

(10) Patent No.: US 9,625,219 B2
(45) Date of Patent: Apr. 18, 2017

(54) EVAPORATOR AND VEHICULAR AIR CONDITIONER USING THE SAME

(71) Applicant: KEIHIN THERMAL TECHNOLOGY CORPORATION, Oyama-shi (JP)

(72) Inventor: Motoyuki Takagi, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 453 days.

(21) Appl. No.: 14/252,779

(22) Filed: Apr. 15, 2014

(65) Prior Publication Data

US 2014/0311703 A1 Oct. 23, 2014

(30) Foreign Application Priority Data

Apr. 23, 2013 (JP) ..... 2013-090386

(51) Int. Cl.
*F28F 9/02* (2006.01)
*F28D 1/053* (2006.01)
*F28D 21/00* (2006.01)

(52) U.S. Cl.
CPC ..... *F28F 9/028* (2013.01); *F28D 1/05391* (2013.01); *F28F 9/0207* (2013.01); *F28D 2021/0085* (2013.01)

(58) Field of Classification Search
CPC ... B60H 1/00021; F28D 1/05391; F28F 9/028
USPC ..... 165/173
See application file for complete search history.

(56) References Cited

U.S. PATENT DOCUMENTS 5,894,886 A * 4/1999 Chiba ..... F28D 1/035 165/173
7,040,385 B2 * 5/2006 Higashiyama ..... F28D 1/0333 165/153
7,044,205 B2 * 5/2006 Higashiyama ..... F28D 1/0341 165/148
7,107,787 B2 * 9/2006 Inaba ..... F25B 39/022 165/176
7,219,511 B2 * 5/2007 Inaba ..... F28D 1/0333 165/153
7,726,387 B2 * 6/2010 Higashiyama ..... F25B 39/022 165/144

(Continued)

FOREIGN PATENT DOCUMENTS

JP 2009-156532 7/2009

*Primary Examiner* — Devon Russell
(74) *Attorney, Agent, or Firm* — Mori & Ward, LLP

(57) ABSTRACT

An evaporator is used in an inclined state in which a first header tank is located on the lower side in relation to a second header tank. The leeward and windward header sections of the first header tank have compartments with which the furthest tube groups of leeward and windward tube rows communicate. The compartments are divided into upper and lower spaces by split flow control sections, and the upper and lower spaces communicate through refrigerant passage holes formed in the split flow control sections. The total cross sectional area of the refrigerant passage holes of the split flow control section of the compartment located on the lower side in the inclined state is smaller than the total cross sectional area of the refrigerant passage holes of the split flow control section of the compartment located on the upper side in the inclined state.

7 Claims, 9 Drawing Sheets

(56) References Cited

U.S. PATENT DOCUMENTS

| | | | | |
|---|---|---|---|---|
| 7,819,177 | B2 * | 10/2010 | Beamer | F28D 1/05375 165/153 |
| 8,991,477 | B2 * | 3/2015 | Katoh | B60H 1/00335 165/202 |
| 9,366,463 | B2 * | 6/2016 | Higashiyama | F25B 39/02 |
| 2003/0127217 | A1 * | 7/2003 | Joboji | F28D 1/0333 165/153 |
| 2003/0188857 | A1 * | 10/2003 | Kawakubo | F28D 1/0476 165/174 |
| 2004/0159121 | A1 * | 8/2004 | Horiuchi | F25B 39/02 62/526 |
| 2006/0191673 | A1 * | 8/2006 | Inaba | F25B 39/022 165/153 |
| 2008/0271479 | A1 * | 11/2008 | Katoh | F25B 39/02 62/515 |
| 2009/0166017 | A1 * | 7/2009 | Katoh | F28D 1/05358 165/153 |
| 2010/0083694 | A1 * | 4/2010 | Takagi | F25B 39/022 62/515 |
| 2010/0206535 | A1 * | 8/2010 | Munoz | F25B 39/028 165/173 |
| 2011/0303401 | A1 * | 12/2011 | Kamoshida | B60H 1/00335 165/173 |
| 2013/0126140 | A1 * | 5/2013 | Park | F28F 9/0273 165/173 |

* cited by examiner

EVAPORATOR AND VEHICULAR AIR CONDITIONER USING THE SAME

BACKGROUND OF THE INVENTION

The present invention relates to an evaporator used in a vehicular air conditioner, which is a refrigeration cycle to be mounted on an automobile, for example, and to a vehicular air conditioner using the same.

Herein and in the appended claims, the upper and lower sides of FIGS. 1 to 4 and 8 will be referred to as "upper" and "lower," respectively.

There has been known an evaporator used in a vehicular air conditioner (see FIG. 14 of Japanese Patent Application Laid-Open (kokai) No. 2009-156532). The known evaporator includes a pair of header tanks which are disposed apart from each other in the vertical direction. A plurality of tube rows are disposed between the header tanks such that they are spaced from one another in an air-passing direction. Each tube row includes a plurality of heat exchange tubes which are disposed such that their longitudinal direction coincides with the vertical direction and they are spaced from one another in the longitudinal direction of the header tanks. Each header tank has leeward and windward header sections which are juxtaposed in the air-passing direction. At least one tube row is disposed between the leeward header sections of the two header tanks, and at least one tube row is disposed between the windward header sections of the two header tanks. Opposite ends of corresponding heat exchange tubes are connected to the leeward header sections of the two header tanks, and opposite ends of the remaining heat exchange tubes are connected to the windward header sections of the two header tanks. A refrigerant inlet is provided at one end of the leeward header section of one header tank, and a refrigerant outlet is provided at one end of the windward header section of the header tank, which end is located on the same side as the one end of the leeward header section. Each of the tube row connected to the leeward header sections of the two header tanks and the tube row connected to the windward header sections of the two header tanks includes a downward flow tube group and an upward flow tube group provided alternatingly. The downward flow tube group is composed of a plurality of heat exchange tubes through which refrigerant flows from the upper side toward the lower side. The upward flow tube group is composed of a plurality of heat exchange tubes through which refrigerant flows from the lower side toward the upper side. The refrigerant having flowed into the evaporator through the refrigerant inlet is caused to pass through the heat exchange tubes of all the tube groups and flow out from the refrigerant outlet. Each of the furthest tube group of the leeward tube row which is furthest from the refrigerant inlet and the furthest tube group of the windward tube row which is furthest from the refrigerant outlet is an upward flow tube group. A single path is formed by the two furthest tube groups juxtaposed in the air passing direction. Compartments respectively communicating with the furthest tube groups of the two tube rows are provided in the leeward and windward header sections of the lower header tank. The two compartments communicate with each other through a communication hole provided in a partition portion between the two compartments.

Incidentally, the evaporator disclosed in the publication may be used in an inclined state as viewed from the outside in the longitudinal direction of the header tanks. In such a case, due to the influence of gravitational force, a larger amount of refrigerant flows into a compartment located on the lower side, which is one of the two compartments of the upper header tank with which the two furthest tube groups communicate. As a result, the amount of refrigerant which flows into the heat exchange tubes of the furthest tube group communicating with the compartment on the lower side becomes larger than the amount of refrigerant which flows into the heat exchange tubes of the furthest tube group communicating with the compartment located on the upper side. Accordingly, imbalance occurs between the amount of refrigerant flowing through the heat exchange tubes located on the leeward side in the path formed by the furthest tube groups and the amount of refrigerant flowing through the heat exchange tubes located on the windward side in the path, whereby the performance of the evaporator may deteriorate.

SUMMARY OF THE INVENTION

An object of the present invention is to solve the above-described problem and to provide an evaporator which can suppress deterioration of performance even when the evaporator is used in an inclined state in which one (first) header tank is located on the upper side in relation to the other (second) header tank. Another object of the present invention is to provide a vehicular air conditioner using such an evaporator.

To fulfill the above object, the present invention comprises the following modes.

1) An evaporator comprising a pair of header tanks whose longitudinal directions coincide with each other and which are disposed apart from each other; and a plurality of tube rows which are disposed between the two header tanks such that they are spaced from one another in an air-passing direction and each of which includes a plurality of heat exchange tubes which are disposed such that their longitudinal direction coincides with a direction connecting the two header tanks and they are spaced from one another in the longitudinal direction of the header tanks, each header tank having leeward and windward header sections which are juxtaposed in the air-passing direction, wherein at least one tube row is disposed between the leeward header sections of the two header tanks and at least one tube row is disposed between the windward header sections of the two header tanks, opposite ends of corresponding heat exchange tubes are connected to the leeward header sections of the two header tanks and opposite ends of the remaining heat exchange tubes are connected to the windward header sections of the two header tanks, a refrigerant inlet is provided at one end of the leeward header section of one header tank and a refrigerant outlet is provided at one end of the windward header section of the header tank, which end is located on the same side as the one end of the leeward header section, the evaporator is configured such that all refrigerant entering through the refrigerant inlet passes through all the heat exchange tubes and flows out from the refrigerant outlet, and the evaporator is used in an inclined state in which a first header tank, one of the two header tanks, is located on the lower side in relation to a second header tank, the other of the two header tanks, as viewed from the outside in the longitudinal direction of the header tanks, each of the tube row connected to the leeward header sections of the two header tanks and the tube row connected to the windward header sections of the two header tanks including a downward flow tube group(s) and an upward flow tube group(s) alternatingly provided, the downward flow tube group being composed of a plurality of heat exchange tubes through which refrigerant flows from the second header tank located on the upper side to the first header tank located on the lower side in the inclined state, the upward flow tube group being composed of a plurality of heat exchange tubes through which refrigerant flows from the first header tank located on the lower side to the second header tank located on the upper side in the inclined state, and a furthest tube group of the leeward tube row furthest from the refrigerant inlet and a furthest tube group of the windward tube row furthest from the refrigerant outlet being upward flow tube groups, being juxtaposed in the air passing direction, and forming a single path, wherein the leeward and windward header sections of the first header tank located on the lower side in the inclined state have respective compartments with which the furthest tube groups of the two tube rows communicate;

the two compartments are divided by split flow control sections in the longitudinal direction of the heat exchange tubes into first spaces located on the side toward the heat exchange tubes and second spaces located on the side opposite the heat exchange tubes;

in each compartment, the first and second spaces communicate with each other through a refrigerant passage hole formed in the corresponding split flow control section, and refrigerant flows from the second space into the first space through the refrigerant passage hole formed in the corresponding split flow control section;

the second spaces of the two compartments communicate with each other through a communication portion provided between the two second spaces;

the corresponding heat exchange tubes communicate with the first spaces of the two compartments; the furthest tube groups of the two tube rows communicate with the two compartments of the leeward and windward header sections of the first header tank; and the total cross sectional area of the refrigerant passage hole formed in the split flow control section of the compartment located on the lower side in the inclined state is smaller than the total cross sectional area of the refrigerant passage hole formed in the split flow control section of the compartment located on the upper side in the inclined state.

2) An evaporator according to par. 1), wherein the refrigerant inlet and the refrigerant outlet are provided on the first header tank which is located on the lower side in the inclined state;

a tube row is disposed between the leeward header sections of the two header tanks, and another tube row is disposed between the windward header sections of the two header tanks;

the leeward tube row includes three tube group, and the windward tube row includes two tube groups;

a nearest tube group of the leeward tube row nearest to the refrigerant inlet and a furthest tube group of the leeward tube row furthest from the refrigerant inlet are upward flow tube groups, and an intermediate tube group of the leeward tube row is a downward flow tube group;

a furthest tube group of the windward tube row furthest from the refrigerant outlet is an upward flow tube group, and a nearest tube group of the windward tube row nearest to the refrigerant outlet is a downward flow tube group;

the nearest tube group of the leeward tube row forms a first path, the intermediate tube group of the leeward tube row forms a second path, the furthest tube groups of the leeward and windward tube rows form a third path, and the nearest tube group of the windward tube row forms a fourth path; and refrigerant having flowed from the intermediate tube group of the leeward tube row into the leeward header section of the first header tank located on the lower side in the inclined state flows into the second space of the compartment of the leeward header section of the first header tank, with which compartment the furthest tube group of the leeward tube row communicates.

3) An evaporator according to par. 1), wherein the total cross sectional area of the refrigerant passage hole formed in the split flow control section of the compartment located on the lower side in the inclined state is 5 to 40% the total cross sectional area of the refrigerant passage hole formed in the split flow control section of the compartment located on the upper side in the inclined state.

4) An evaporator according to par. 3), wherein the first header tank located on the lower side in the inclined state includes a first member to which the heat exchange tubes are connected, a second member joined to the first member and covering a side of the first member opposite the heat exchange tubes, and a third member disposed between the first member and the second member and having partition portions which divide, in the vertical direction, the interiors of the leeward and windward header sections of the first header tank into upper and lower spaces;

the interiors of the leeward and windward header sections of the first header tank are divided in the longitudinal direction of the first header tank by division plates inserted in the slits formed in the partition portions of the third member such that a plurality of compartments are formed in each of the leeward and windward header sections;

the compartments of the leeward and windward header sections of the first header tank furthest from the refrigerant inlet and the refrigerant outlet, respectively, are the compartments with which the furthest tube groups of the leeward and windward tube rows communicate;

the heat exchange tubes communicate with the upper spaces of the leeward and windward header sections of the first header tank;

refrigerant passage holes formed in the partition portions of the third member establish communication between the two spaces of the leeward header section of the first header tank and establish communication between the two spaces of the windward header section of the first header tank; and parts of the partition portions of the third member, which parts are present in the compartments with which the furthest tube groups of the two tube rows communicate, serve as the split flow control sections.

5) A vehicular air conditioner comprising a casing having an air flow passage, a temperature adjustment section which is provided in the casing and which adjusts the temperature of air fed into the casing, a blower which feeds air into the air flow passage inside the casing and blows out to a vehicle cabin the air whose temperature has been adjusted by the temperature adjustment section, the temperature adjustment section including an evaporator disposed in the air flow passage inside the casing, wherein the evaporator of the temperature adjustment section is an evaporator according to any one of pars. 1) to 4), and the evaporator is disposed in an inclined state in which the first header tank is located on the lower side in relation to the second header tank as viewed from the outside in the longitudinal direction of the header tanks.

6) A vehicular air conditioner according to par. 5), wherein an air heating section and a detour section for detour around the air heating section are provided in the air flow passage of the casing to be located downstream of the evaporator with respect to an air flow direction; and the temperature adjustment section includes a heater core disposed in the air heating section of the air flow passage of the casing, and an air mix damper which adjusts a ratio between an amount of air which is fed to the heater core after passing through the evaporator and an amount of air which detours around the heater core after passing through the evaporator.

According to an evaporator of pars. 1) to 4), compartments with which the furthest tube groups of the two tube rows communicate are provided in the leeward and windward header sections of the first header tank which is located on the lower side in the inclined state in which the first header tank is located on the lower side in relation to the second header tank as viewed from the outside in the longitudinal direction of the header tanks; the two compartments are divided by split flow control sections in the longitudinal direction of the heat exchange tubes into first spaces located on the side toward the heat exchange tubes and second spaces located on the side opposite the heat exchange tubes; in each compartment, the first and second spaces communicate with each other through a refrigerant passage hole formed in the corresponding split flow control section, and refrigerant flows from the second space into the first space through the refrigerant passage hole formed in the corresponding split flow control section; the second spaces of the two compartments communicate with each other through a communication portion provided between the two second spaces; the corresponding heat exchange tubes communicate with the first spaces of the two compartments; the furthest tube groups of the two tube rows communicate with the two compartments of the leeward and windward header sections of the first header tank; and the total cross sectional area of the refrigerant passage hole formed in the split flow control section of the compartment located on the lower side in the inclined state is smaller than the total cross sectional area of the refrigerant passage hole formed in the split flow control section of the compartment located on the upper side in the inclined state. Therefore, even in the case where the evaporator is used in an inclined state in which one (first) header tank is located on the lower side in relation to the other (second) header tank as viewed from the outside in the longitudinal direction of the header tanks, the amount of refrigerant flowing through the heat exchange tubes located on the leeward side in the path formed by the two furthest tube groups is made equal to the amount of refrigerant flowing through the heat exchange tubes located on the windward side in the path, whereby deterioration of the performance of the evaporator is suppressed. Namely, when refrigerant flows into the second spaces of the two compartments of the first header tank with which the two furthest tube groups communicate, due to the influence of gravitational force, a large amount of refrigerant flows into the second space of a compartment which is one of the two compartments and is located on the lower side. However, since the total cross sectional area of the refrigerant passage hole formed in the split flow control section of the compartment located on the lower side is smaller than the total cross sectional area of the refrigerant passage hole formed in the split flow control section of the compartment located on the upper side, in the compartment located on the lower side, the resistance acting on the flow of refrigerant which flows from the second space to the first space becomes large, as compared with the compartment located on the upper side, and, in the compartment located on the lower side, the amount of refrigerant which flows from the second space to the first space decreases, as compared with the compartment located on the upper side. Accordingly, the amount of refrigerant flowing from the first space of the compartment located on the lower side into the heat exchange tubes of the corresponding furthest tube group is rendered equal to the amount of refrigerant flowing from the first space of the compartment located on the upper side into the heat exchange tubes of the corresponding furthest tube group. As a result, the amount of refrigerant flowing through the heat exchange tubes located on the leeward side in the path formed by the two furthest tube groups is rendered equal to the amount of refrigerant flowing through the heat exchange tubes located on the windward side in the path, whereby deterioration of the performance of the evaporator is suppressed.

According to the evaporator of par. 3), when the evaporator is used in an inclined state in which one (first) header tank is located on the upper side in relation to the other (second) header tank as viewed from the outside in the longitudinal direction of the header tanks, the amount of refrigerant flowing from the first space of the compartment located on the lower side into the heat exchange tubes of the corresponding furthest tube group is effectively rendered equal to the amount of refrigerant flowing from the first space of the compartment located on the upper side into the heat exchange tubes of the corresponding furthest tube group.

According to the evaporator of par. 4), it is possible to relatively simply perform the following: proving, in the leeward and windward header sections of the first header tank located on the lower side in the inclined state, compartments with which the furthest tube groups of the two tube rows communicate, dividing the two compartments into upper and lower spaces by the split flow control sections, forming the refrigerant passage holes in the split flow control sections, providing the communication portion in the partition portion between the two second spaces so as to connect the second spaces of the two compartments, and rendering the total cross sectional area of the refrigerant passage hole formed in the split flow control section of the compartment located on the lower side when used in the inclined state smaller than the total cross sectional area of the refrigerant passage hole formed in the split flow control section of the compartment located on the upper side.

According to the vehicular air conditioner of pars. 5) and 6), when refrigerant flows into the second spaces of the two compartments of the first header tank of the evaporator with which the two furthest tube groups communicate, due to the influence of gravitational force, a large amount of refrigerant flows into the second space of a compartment which is one of the two compartments and is located on the lower side. However, since the total cross sectional area of the refrigerant passage hole formed in the split flow control section of the compartment located on the lower side in the first header tank of the evaporator is smaller than the total cross sectional area of the refrigerant passage hole formed in the split flow control section of the compartment located on the upper side in the first header tank, in the compartment located on the lower side, the resistance acting on the flow of refrigerant which flows from the second space to the first space becomes large, as compared with the compartment located on the upper side, and, in the compartment located on the lower side, the amount of refrigerant which flows from the second space to the first space decreases, as compared with the compartment located on the upper side. Accordingly, the amount of refrigerant flowing from the first space of the compartment located on the lower side into the heat exchange tubes of the corresponding furthest tube group is rendered equal to the amount of refrigerant flowing from the first space of the compartment located on the upper side into the heat exchange tubes of the corresponding furthest tube group. As a result, the amount of refrigerant flowing through the heat exchange tubes located on the leeward side in the path formed by the two furthest tube groups is rendered equal to the amount of refrigerant flowing through the heat exchange tubes located on the windward side in the path, whereby deterioration of the performance of the evaporator is suppressed.

DESCRIPTION OF THE PREFERRED EMBODIMENT

An embodiment of the present invention will next be described with reference to the drawings. In the embodiment to be described later, the evaporator of the present invention is applied to a refrigeration cycle which constitutes a vehicular air conditioner.

The term "aluminum" as used in the following description encompasses aluminum alloys in addition to pure aluminum.

Figure 2:
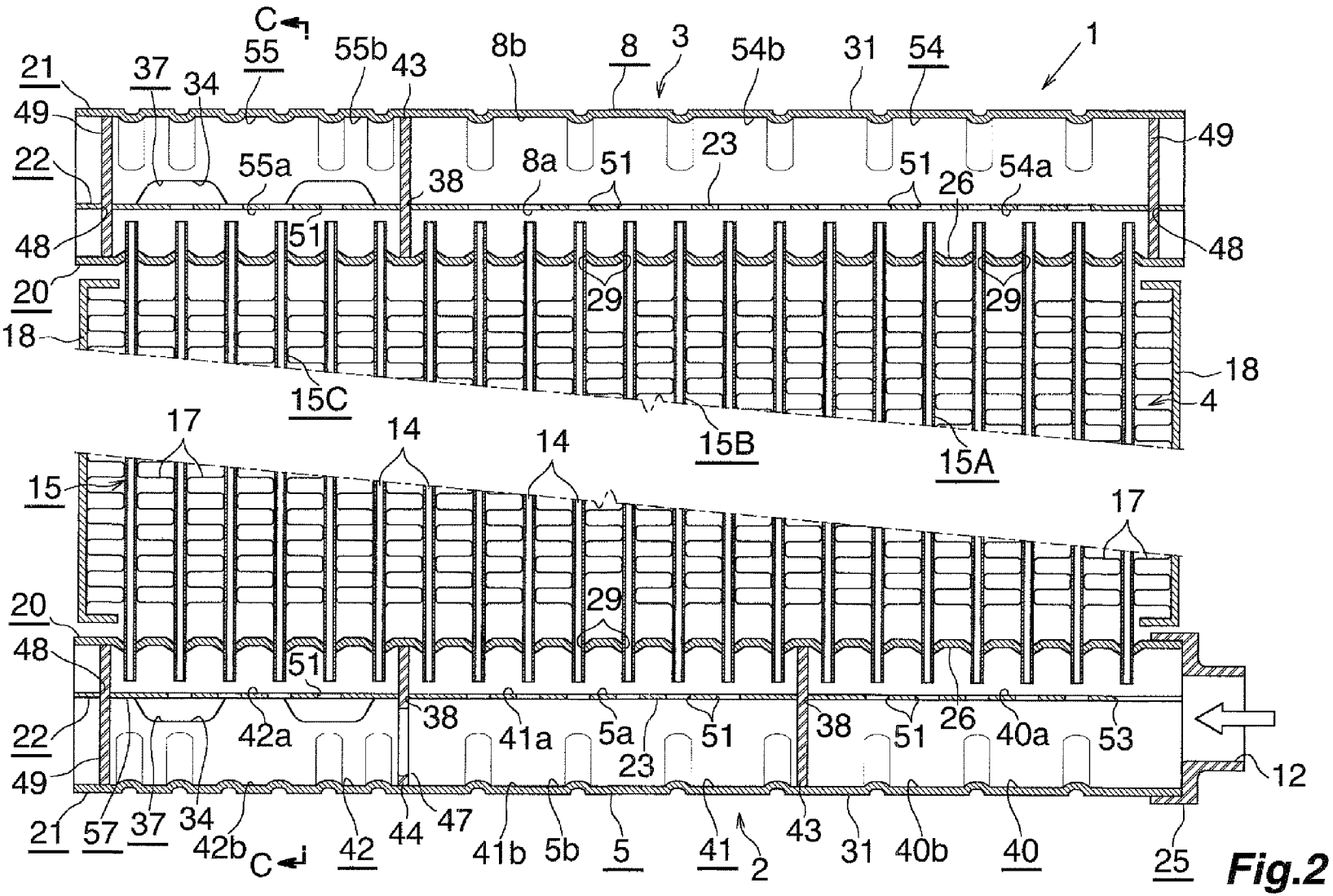
FIG. 2 is a partially omitted enlarged sectional view taken along line A-A of FIG. 1.
Figure 3:
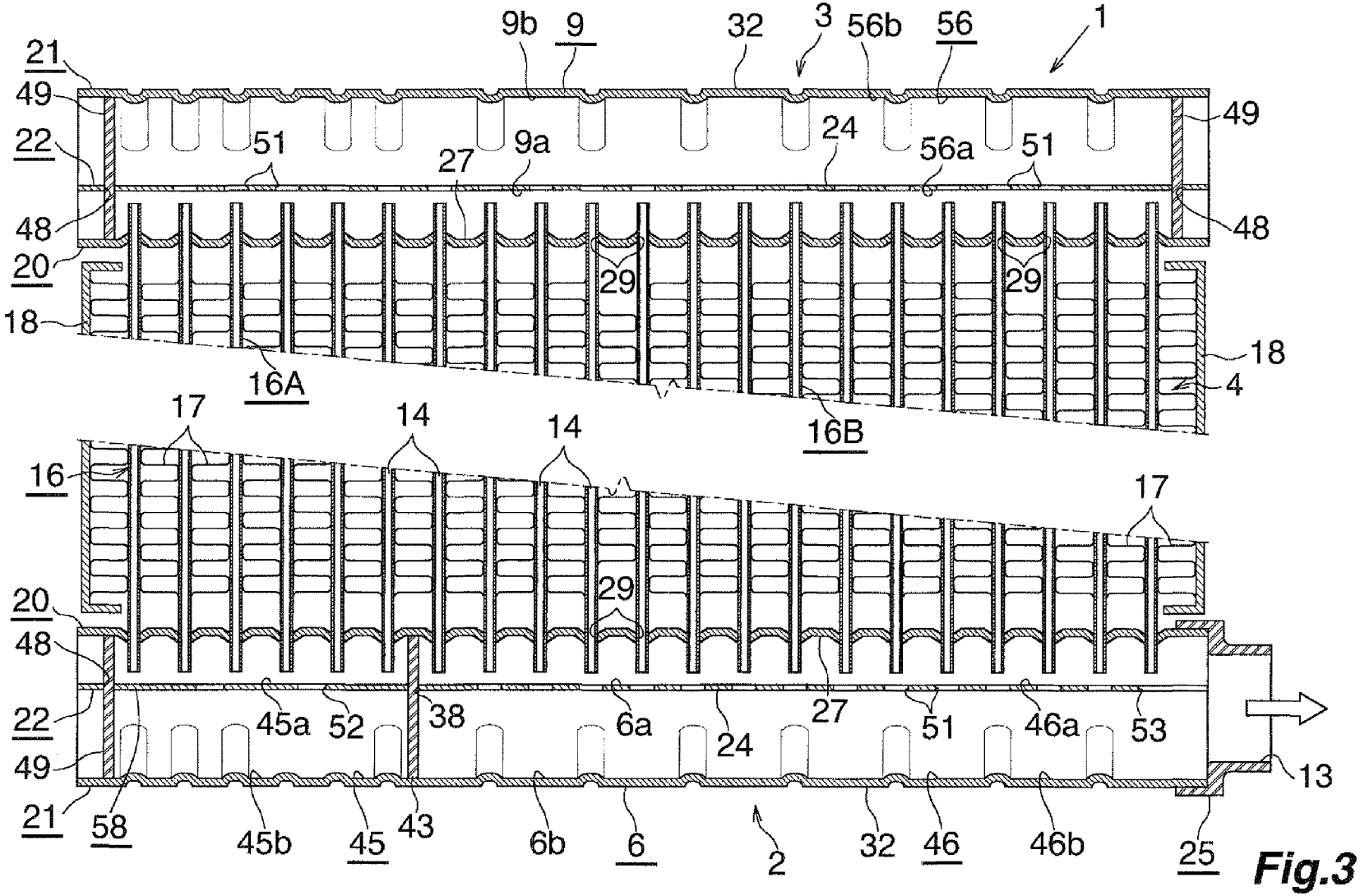
FIG. 3 is a partially omitted enlarged sectional view taken along line B-B of FIG. 1.

In the following description, the downstream side with respect to an air-passing direction (a direction represented by arrow X in the drawings), which is the direction of air passing through air-passing clearances between adjacent heat exchange tubes, will be referred to as the "front," and the opposite side as the "rear." Also, the left-hand and right-hand sides of FIGS. 1 to 3 will be referred to as "left" and "right," respectively.

Figure 1:
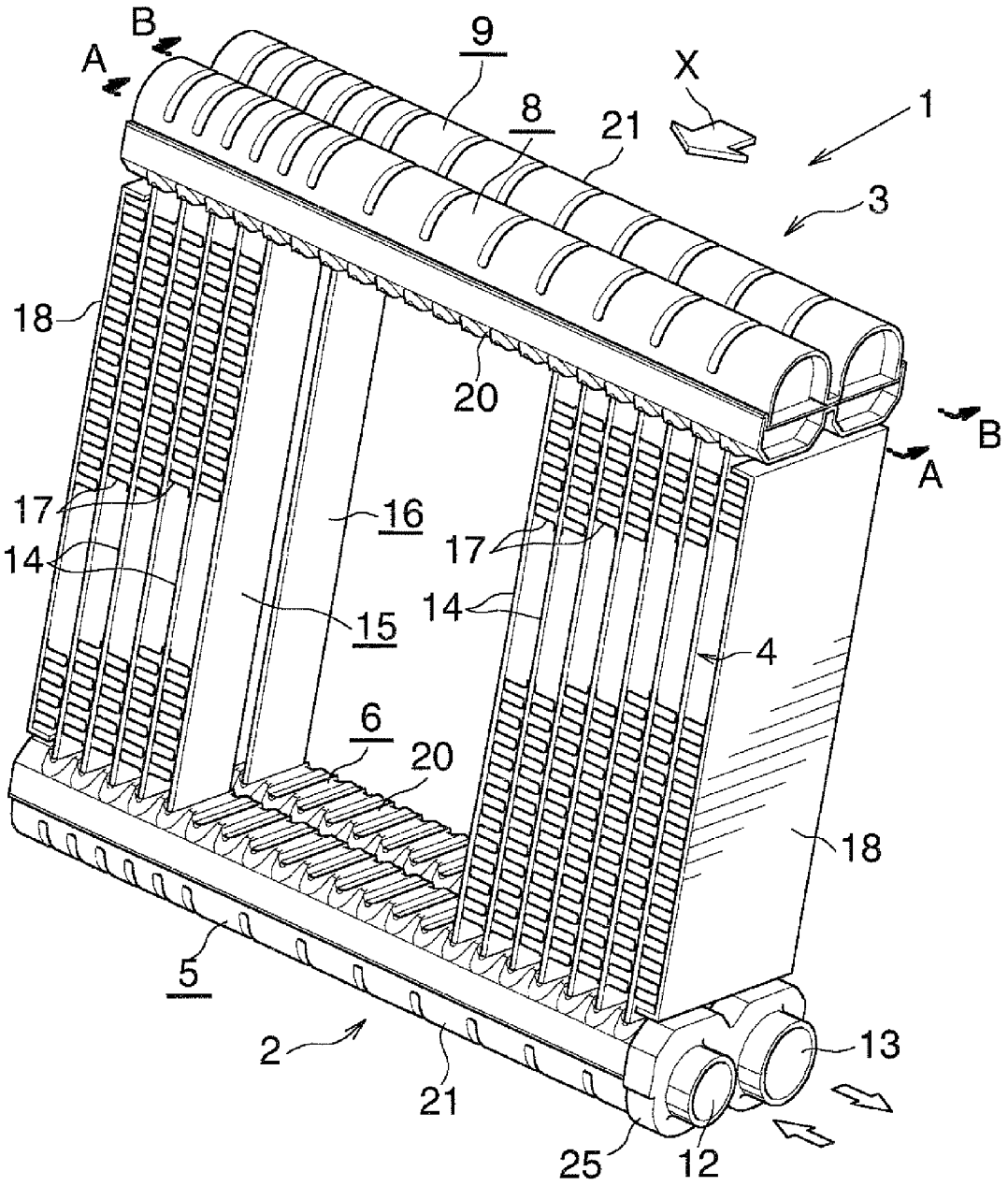
FIG. 1 is a partially cut-away perspective view showing the overall structure of an evaporator of the present invention.
Figure 7:
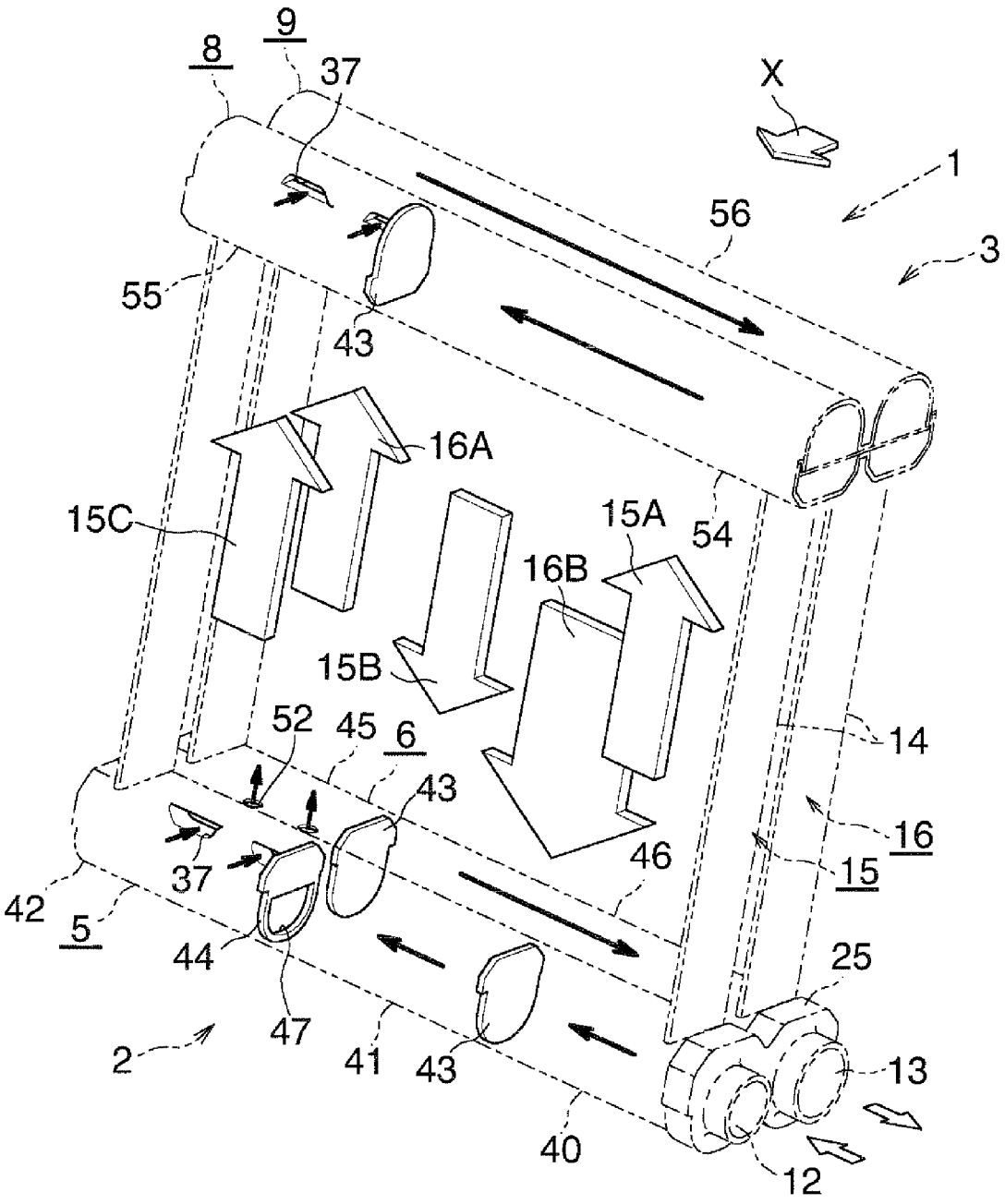
FIG. 7 is a view showing the flow of refrigerant in the evaporator of FIG. 1.

FIG. 1 shows the overall structure of an evaporator to which the evaporator of the present invention is applied. FIGS. 2 to 6 schematically show its structure. FIG. 7 shows the flow of refrigerant in the evaporator of FIG. 1.

As shown in FIGS. 1 to 4, an evaporator 1 includes a first header tank 2 and a second header tank 3, which are formed of aluminum, and a heat exchange core section 4 provided between the two header tanks 2 and 3. The first header tank 2 and the second header tank 3 are disposed apart from each such that their longitudinal directions coincide with each other. The evaporator 1 is used in an inclined state in which the first header tank 2 is located on the lower side in relation to the second header tank 3 as viewed from the outside (from the left side or the right side) in the longitudinal direction of the header tanks 2 and 3. Notably, in the present embodiment, the second header tank 3 is located on the windward side in relation to the first header tank 2.

The first header tank 2 includes a leeward header section 5 disposed on the leeward side (front side) such that their longitudinal direction coincides with the left-right direction; a windward header section 6 disposed on the windward side (rear side) such that their longitudinal direction coincides with the left-right direction; and a connection portion 7 which connects and unites the two header sections 5 and 6 together. The second header tank 3 includes a leeward header section 8 disposed on the leeward side (front side) such that their longitudinal direction coincides with the left-right direction; a windward header section 9 disposed on the windward side (rear side) such that their longitudinal direction coincides with the left-right direction; and a connection portion 11 which connects and unites the two header sections 8 and 9 together. In the following description, the leeward header section 5 of the first header tank 2 will be referred as a leeward lower header section; the leeward header section 8 of the second header tank 3 will be referred to as a leeward upper header section; the windward header section 6 of the first header tank 2 will be referred to as a windward lower header section; and the windward header section 9 of the second header tank 3 will be referred to as a windward upper header section. A refrigerant inlet 12 is provided at the right end of the leeward lower header section 5, and a refrigerant outlet 13 is provided at the right end of the windward lower header section 6.

In the heat exchange core section 4, two tube rows 15 and 16 are juxtaposed in the front-rear direction. Each of the tube rows 15 and 16 is composed of a plurality of flat heat exchange tubes 14 which are formed of aluminum extrudate and which are disposed such that they are spaced apart from one another in the left-right direction and such that their longitudinal direction coincides with a direction connecting the two header tanks 2 and 3 and their width direction coincides with the air-passing direction. Corrugate fins 17 formed of aluminum are disposed in air-passing clearances between adjacent heat exchange tubes 14 of each of the tube rows 15 and 16 and on the outer sides of the heat exchange tubes 14 at the left and right ends such that the corrugate fins 17 extend across the heat exchange tubes 14 of the front and rear tube rows 15 and 16. The corrugate fins 17 are brazed to the corresponding heat exchange tubes 14. Side plates 18 formed of aluminum are disposed on the outer sides of the corrugate fins 17 at the left and right ends and are brazed to the corresponding corrugate fins 17. Upper and lower end portions of the heat exchange tubes 14 of the leeward tube row 15 are communicatably connected to the leeward upper and lower header sections 8 and 5 in a state in which the upper and lower end portions project into the interiors of the leeward upper and lower header sections 8 and 5. Upper and lower end portions of the heat exchange tubes 14 of the windward tube row 16 are communicatably connected to the windward upper and lower header sections 9 and 6 in a state in which the upper and lower end portions project into the interiors of the windward upper and lower header sections 9 and 6. Notably, the number of the heat exchange tubes 14 of the leeward tube row 15 is equal to the number of the heat exchange tubes 14 of the windward tube row 16. The front and rear heat exchange tubes 14, which constitute the leeward tube row 15 and the windward tube row 16, respectively, share the corrugate fins 17.

In the leeward tube row 15, three tube groups 15A, 15B, and 15C, each composed of a plurality of heat exchange tubes 14 disposed such that they are spaced apart from one another in the left-right direction, are provided from the right end toward the left end. In the windward tube row 16, two tube groups 16A and 16B, which is one smaller in number than the tube groups of the leeward tube row 15 and each of which is composed of a plurality of heat exchange tubes 14 disposed such that they are spaced apart from one another in the left-right direction, are provided from the left end toward the right end. The three tube groups 15A, 15B, and 15C of the leeward tube row 15 will be referred to as the first through third tube groups from the end where the refrigerant inlet 12 is provided (the right end) toward the other end (the left end). The two tube groups 16A and 16B of the windward tube row 16 will be referred to as the fourth and fifth tube groups from the end opposite the refrigerant outlet 13 (the left end) toward the end where the refrigerant outlet 13 is provided (the right end).

As shown in FIGS. 2 to 5, the first header tank 2 includes a first member 20, a second member 21, a third member 22, and an end member 25, which are formed of aluminum. The first member 20 forms upper portions of the leeward lower header section 5 and the windward lower header section 6, which portions are located on the side toward the heat exchange tubes 14, and the heat exchange tubes 14 of the two tube rows 15 and 16 are connected to the first member 20. The second member 21 is brazed to the first member 20, covers the side (lower side) of the first member 20 opposite the heat exchange tubes 14, and forms lower portions of the leeward lower header section 5 and the windward lower header section 6. The third member 22 is disposed between the first member 20 and the second member 21 and has front and rear partition portions 23 and 24 for dividing the interiors of the leeward lower header section 5 and the windward lower header section 6 into upper spaces 5*a* and 6*a* and lower spaces 5*b* and 6*b*. The end member 25 has the refrigerant inlet 12 and the refrigerant outlet 13, and is brazed to the right ends of the first through third members 20, 21, and 22.

The first member 20 is formed by performing press work on an aluminum brazing sheet having a brazing material layer on each of opposite sides thereof. The first member 20 includes a first header forming portion 26 which has a generally inverted U-like shape as viewed on a transverse cross section thereof and which forms an upper portion of the leeward lower header section 5; a second header forming portion 27 which has a generally inverted U-like shape as viewed on a transverse cross section thereof and which forms an upper portion of the windward lower header section 6; and a connection wall 28 which connects the two header forming portions 26 and 27 together and which forms an upper portion of the connection portion 7. Tube insertion holes 29 elongated in the front-rear direction are formed in the header forming portions 26 and 27 of the first member 20 such that they are spaced from one another in the left-right direction and the tube insertion holes 29 of the header forming portion 26 are located at the same positions (in the left-right direction) as those of the corresponding tube insertion holes 29 of the header forming portion 27. Lower end portions of the heat exchange tubes 14 are inserted into the tube insertion holes 29 and are brazed to the first member 20 by making use of the brazing material layer of the first member 20.

The second member 21 is formed by performing press work on an aluminum brazing sheet having a brazing material layer on each of opposite sides thereof. The second member 21 includes a first header forming portion 31 which has a generally U-like shape as viewed on a transverse cross section thereof and which forms a lower portion of the leeward lower header section 5; a second header forming portion 32 which has a generally U-like shape as viewed on a transverse cross section thereof and which forms a lower portion of the windward lower header section 6; and a connection wall 33 which connects the two header forming portions 31 and 32 together and which forms a lower portion of the connection portion 7. At a position of the second member 21 where the third tube group 15C is provided, downward concaved recesses 34 which are open toward the side where the heat exchange tubes 14 are present are formed by deforming the first header forming portion 31, the second header forming portion 32, and the connection wall 33 such that the recesses 34 are spaced from each other in the left-right direction.

The third member 22 is formed by performing press work on an aluminum brazing sheet having a brazing material layer on each of opposite sides thereof. The front and rear partition portions 23 and 24 of the third member 22 are connected and united together by a connection wall 36 which is disposed between the connection wall 28 of the first member 20 and the connection wall 33 of the second member 21 and is brazed to the two connection walls 28 and 33. The connection wall 36 forms an intermediate portion (with respect to the vertical direction) of the connection portion 7. The upper end openings of the recesses 34 of the second member 21 are closed by the connection wall 36 of the third member 22. Thus, there are provided communication passages 37 for establishing communication between the lower space 5*b* of the leeward lower header section 5 and the lower space 6*b* of the windward lower header section 6.

Slits 38 elongated in the front-rear direction are formed in the front partition section 23 of the third member 22 at a position between the first tube group 15A and the second tube group 15B and at a position between the second tube group 15B and the third tube group 15C. Similarly, slits 38 elongated in the front-rear direction are formed in the rear partition section 24 of the third member 22 at a position between the fourth tube group 16A and the fifth tube group 16B. Division plates 43 and 44 are inserted into the slits 38 of the front partition section 23 in order to divide the interior of the leeward lower header section 5, in the left-right direction, into compartments 40, 41, and 42, the number of which is equal to the number of the tube groups 15A, 15B, and 15C of the leeward tube row 15. A division plate 43 is inserted into the slit 38 of the rear partition section 24 in order to divide the interior of the windward lower header section 6, in the left-right direction, into compartments 45 and 46, the number of which is equal to the number of the tube groups 16A and 16B of the windward tube row 16. The division plates 43 and 44 are brazed to the first through third members 20, 21, and 22. Each of the division plates 43 and 44 is formed of an aluminum brazing sheet having a brazing material layer on each of opposite sides thereof. Notably, since the interiors of the leeward lower header section 5 and the windward lower header section 6 are divided by the front and rear partition portions 23 and 24 of the third member 22 into the upper and lower spaces 5*a*, 5*b*, 6*a*, and 6*b*, the interiors of the compartments 40, 41, 42, 45, and 46 are partitioned into upper and lower spaces 40*a* and 40*b*, 41*a* and 41*b*, 42*a* and 42*b*, 45*a* and 45*b*, and 46*a* and 46*b*. Namely, the interiors of the compartments 40, 41, 42, 45, and 46 are partitioned, in the longitudinal direction of the heat exchange tubes 14, into upper spaces (first spaces) 40*a*, 41*a*, 42*a*, 45*a*, and 46*a* which are located on the side toward the heat exchange tubes 14 and lower spaces (second spaces) 40*b*, 41*b*, 42*b*, 45*b*, and 46*b* which are located on the side opposite the heat exchange tubes 14. A through hole 47 for connecting the lower spaces 41*b* and 42*b* of the second compartment 41 and the third compartment 42 of the leeward lower header section 5 is formed in a lower portion of the division plate 44 between the second compartment 41 and the third compartment 42, which portion is located within the lower space 5*b*.

The total length (in the left-right direction) of the first compartment 40 and the second compartment 41 of the leeward lower header section 5 is equal to the length (in the left-right direction) of the fifth compartment 46 of the windward lower header section 6, and the length (in the left-right direction) of the third compartment 42 of the leeward lower header section 5 is equal to the length (in the left-right direction) of the fourth compartment 45 of the windward lower header section 6.

The three compartments 40, 41, and 42 of the leeward lower header section 5 will be referred to as first through third compartments from the end where the refrigerant inlet 12 is provided (the right end) toward the opposite end (the left end), and the two compartments 45 and 46 of the windward lower header section 6 will be referred to as fourth through fifth compartments from the end opposite the refrigerant outlet 13 (the left end) toward the end where the refrigerant outlet 13 is provided (the right end). The heat exchange tubes 14 of the first through third tube groups 15A, 15B, and 15C communicate with the upper spaces 40*a*, 41*a*, and 42*a* of the first through third compartments 40, 41, and 42. The heat exchange tubes 14 of the fourth and fifth tube groups 16A and 16B communicate with the upper spaces 45*a* and 46*a* of the fourth and fifth compartments 45 and 46.

A slit 48 elongated in the front-rear direction is formed in the front partition section 23 of the third member 22 at a position leftward of the third tube group 15C, and another slit 48 elongated in the front-rear direction is formed in the rear partition section 24 of the third member 22 at a position leftward of the fourth tube group 16A. A closing plate 49 for closing the left end of the leeward lower header section 5 is inserted into the slit 48 of the front partition portion 23 and is brazed to the first through third members 20, 21, and 22. Another closing plate 49 for closing the left end of the windward lower header section 6 is inserted into the slit 48 of the rear partition portion 24 and is brazed to the first through third members 20, 21, and 22. The closing plates 49 are formed from an aluminum brazing sheet having a brazing material layer on each of opposite sides thereof.

Refrigerant passage holes 51 which are formed in the front and rear partition sections 23 and 24 of the third member 22 at positions immediately under the heat exchange tubes 14 and which are elongated in the front-rear direction establish communication between the upper and lower spaces 40*a* and 40*b*, 41*a* and 41*b*, and 42*a* and 42*b* of the first through third compartments 40, 41, and 42 of the leeward lower header section 5, and establish communication between the upper and lower spaces 46*a* and 46*b* of the fifth compartment 46 of the windward lower header section 6. Since the length of the refrigerant passage holes 51 in the front-rear direction is smaller than the width of the heat exchange tubes 14 in the front-rear direction, front and rear end portions of the heat exchange tubes 14 project outward from the front and rear end portions of the corresponding refrigerant passage holes 51 in the front-rear direction.

The upper and lower spaces 45*a* and 45*b* of the fourth compartment 45 of the windward lower header section 6 communicate with each other through a plurality of circular refrigerant passage holes 52 which are formed in a central portion (in the front-rear direction) of the rear partition section 24 of the third member 22 such that they are spaced from one another in the left-right direction. Preferably, the total cross sectional area of the plurality of circular refrigerant passage holes 52 is 5 to 40% the total cross sectional area of the refrigerant passage holes 51 of the front partition section 23 which establish communication between the upper and lower spaces 42*a* and 42*b* of the third compartment 42.

Each of the front and rear partition portions 23 and 24 of the third member 22 has a cutout 53 extending from the right end thereof. The cutout 53 of the front partition portion 23 establishes communication between the upper and lower spaces 40*a* and 40*b* of the first compartment 40, and the refrigerant inlet 12 communicates with the upper and lower spaces 40*a* and 40*b*. The cutout 53 of the rear partition portion 24 establishes communication between the upper and lower spaces 46*a* and 46*b* of the fifth compartment 46, and the refrigerant outlet 13 communicates with the upper and lower spaces 46*a* and 46*b*.

The lower space 42*b* of the third compartment 42 of the leeward lower header section 5 which is furthest from the refrigerant inlet 12 communicates, through the communication passages 37, with the lower space 45*b* of the fourth compartment 45 of the windward lower header section 6 which is furthest from the refrigerant outlet 13.

As shown in FIGS. 2 to 4 and 6, the second header tank 3 and the first header tank 2 are substantially identical in structure and are disposed in a mirror-image relation. Therefore, portions of the second header tank 3 identical with those of the first header tank 2 are denoted by the same reference numerals. Notably, the refrigerant inlet 12 and the refrigerant outlet 13 are not provided on the second header tank 3, and therefore, the end member 25 is also not provided on the second header tank 3. The first member 20 forms the lower portions (portions on the side toward the heat exchange tubes 14) of the leeward upper header section 8 and the windward upper header section 9. The second member 21 covers the side (upper side) of the first member 20 opposite the heat exchange tubes 14, and forms the upper portions of the leeward upper header section 8 and the windward upper header section 9. The front partition portion 23 of the third member 22 divides the interior of the leeward upper header section 8 into upper and lower spaces 8*b* and 8*a*, and the rear partition portion 24 of the third member 22 divides the interior of the windward upper header section 9 into upper and lower spaces 9*b* and 9*a*. The lower spaces 8*a* and 9*a* of the leeward upper header section 8 and the windward upper header section 9 have configurations similar to those of the upper spaces 5*a* and 6*a* of the leeward lower header section 5 and the windward lower header section 6. The upper spaces 8*b* and 9*b* of the leeward upper header section 8 and the windward upper header section 9 have configurations similar to those of the lower spaces 5*b* and 6*b* of the leeward lower header section 5 and the windward lower header section 6. Notably, the first and second members 20 and 21 of the second header tank 3 have configurations identical to those of the first and second members 20 and 21 of the first header tank 2.

A slit 38 elongated in the front-rear direction is formed in the front partition section 23 of the third member 22 at a position between the second tube group 15B and the third tube group 15C. A division plate 43 is inserted into the slit 38 in order to divide the interior of the leeward upper header section 8, in the left-right direction, into compartments 54 and 55, the number of which is one smaller than the number of the tube groups 15A, 15B, and 15C of the leeward tube row 15. The division plate 43 is brazed to the first through third members 20, 21, and 22. The two compartments 54 and 55 of the leeward upper header section 8 will be referred to as first through second compartments from the end where the refrigerant inlet 12 is provided (the right end) toward the opposite end (the left end). The entirety of the interior of the windward upper header section 9 serves as a compartment 56 which is one smaller in number than the tube groups 16A and 16B of the windward tube row 16. This compartment 56 will be referred to as a third compartment. Notably, since the interiors of the leeward upper header section 8 and the windward upper header section 9 are divided by the front and rear partition portions 23 and 24 of the third member 22 into the upper and lower spaces 8*b*, 8*a*, 9*b*, and 9*a*, the interiors of the compartments 54, 55, and 56 are partitioned into upper and lower spaces 54*b* and 54*a*, 55*b* and 55*a*, 56*b* and 56*a*. The heat exchange tubes 14 of the first through third tube groups 15A, 15B, and 15C communicate with the lower spaces 54*a* and 55*a* of the first and second compartments 54 and 55. The heat exchange tubes 14 of the fourth and fifth tube groups 16A and 16B communicate with the lower space 56*a* of the third compartment 56.

The total length (in the left-right direction) of the first and second compartments 54 and 55 of the leeward upper header section 8 is equal to the length (in the left-right direction) of the third compartment 56 of the windward upper header section 9. The length (in the left-right direction) of the second compartment 55 of the leeward upper header section 8 is equal to the length (in the left-right direction) of the third compartment 42 of the leeward lower header section 5 and the length (in the left-right direction) of the fourth compartment 45 of the windward lower header section 6. The length (in the left-right direction) of the first compartment 54 of the leeward upper header section 8 is equal to the total length (in the left-right direction) of the first and second compartments 40 and 41 of the leeward lower header section 5 and is equal to the length (in the left-right direction) of the fifth compartment 46 of the windward lower header section 6.

Refrigerant passage holes 51 which are formed in the front and rear partition sections 23 and 24 at positions immediately above the heat exchange tubes 14 and which are elongated in the front-rear direction establish communication between the upper and lower spaces 54*b* and 54*a* and 55*b* and 55*a* of the first and second compartments 54 and 55 of the leeward upper header section 8, and establish communication between the upper and lower spaces 56*b* and 56*a* of the third compartment 56 of the windward upper header section 9. Since the length of the refrigerant passage holes 51 in the front-rear direction is smaller than the width of the heat exchange tubes 14 in the front-rear direction, front and rear end portions of the heat exchange tubes 14 project outward from the front and rear end portions of the corresponding refrigerant passage holes 51 in the front-rear direction.

The lower space 55*a* of the second compartment 55 of the leeward upper header section 8 communicates, through communication passages 37, with the lower space 56*a* of the third compartment 56 of the windward upper header section 9. A slit 48 elongated in the front-rear direction is formed in the front partition section 23 of the third member 22 at a position rightward of the first tube group 15A, and another slit 48 elongated in the front-rear direction is formed in the rear partition section 24 of the third member 22 at a position rightward of the fifth tube group 16B. A closing plate 49 for closing the right end of the leeward upper header section 8 is inserted into the slit 48 of the front partition portion 23 and is brazed to the first through third members 20, 21, and 22. Another closing plate 49 for closing the right end of the windward upper header section 9 is inserted into the slit 48 of the rear partition portion 24 and is brazed to the first through third members 20, 21, and 22.

Since the refrigerant inlet 12, the refrigerant outlet 13, the communication passages 37, the compartments 40, 41, 42, 45, and 46, the division plates 43 and 44, the refrigerant passage holes 51, the circular refrigerant passage holes 52, the cutouts 53, the compartments 54, 55, and 56 are provided in the above-described manner, refrigerant flows, from the lower side toward the upper side, through the heat exchange tubes 14 of the first tube group 15A, the third tube group 15C furthest from the refrigerant inlet 12 (the furthest tube group of the leeward tube row 15), and the fourth tube group 16A furthest from the refrigerant outlet 13 (the furthest tube group of the windward tube row 16). Therefore, these tube groups 15A, 15C, and 16A are upward flow tube groups. Also, refrigerant flows, from the upper side toward the lower side, through the heat exchange tubes 14 of the second tube group 15B and the fifth tube group 16B. Therefore, these tube groups 15B and 16B are downward flow tube groups. The flow direction of refrigerant in the heat exchange tubes 14 of the third tube group 15C (the furthest tube group) of the leeward tube row 15 furthest from the refrigerant inlet 12 is the same as the flow direction of refrigerant in the heat exchange tubes 14 of the fourth tube group 16A (the furthest tube group) of the windward tube row 16 furthest from the refrigerant outlet 13. Accordingly, as shown in FIG. 7, refrigerant having entered through the refrigerant inlet 12 flows along two routes as follows, and flows out from the refrigerant outlet 13. The first route is formed by the first compartment 40, the first tube group 15A, the first compartment 54, the second tube group 15B, the second compartment 41, the third compartment 42, the fourth compartment 45, the fourth tube group 16A, the third compartment 56, the fifth tube group 16B, and the fifth compartment 46. The second route is formed by the first compartment 40, the first tube group 15A, the first compartment 54, the second tube group 15B, the second compartment 41, the third compartment 42, the third tube group 15C, the second compartment 55, the third compartment 56, the fifth tube group 16B, and the fifth compartment 46. The first tube group 15A forms a first path, the second tube group 15B forms a second path, the third and fourth tube groups 15C and 16A form a third path, and the fifth tube group 16B forms a fourth path.

Parts of the front and rear partition portions 23 and 24 of the third member 22 of the first header tank 2, which parts partition the compartments 42 and 45, with which the third and fourth tube groups 15C and 16A (the furthest tube groups) communicate, into the upper and lower spaces 42*a*, 42*b*, 45*a*, and 45*b*, serve as split flow control sections 57 and 58 which control the split flow of refrigerant into the two tube groups 15C and 16A of the third path. Accordingly, the total cross sectional area of the circular refrigerant passage holes 52 formed in the split flow control section 58 of the fourth compartment 45—which is located on the lower side when the evaporator is disclosed in an inclined state in which the first header tank 2 is located on the lower side in relation to the second header tank 3 as viewed from the outside in the longitudinal direction of the header tanks 2 and 3—is smaller than the total cross sectional area of the refrigerant passage holes 51 formed in the split flow control section 57 of the third compartment 42 located on the upper side. The total cross sectional area of the circular refrigerant passage holes 52 is 5 to 40% the total cross sectional area of the refrigerant passage holes 51 of the split flow control section 57 of the third compartment 42.

Figure 8:
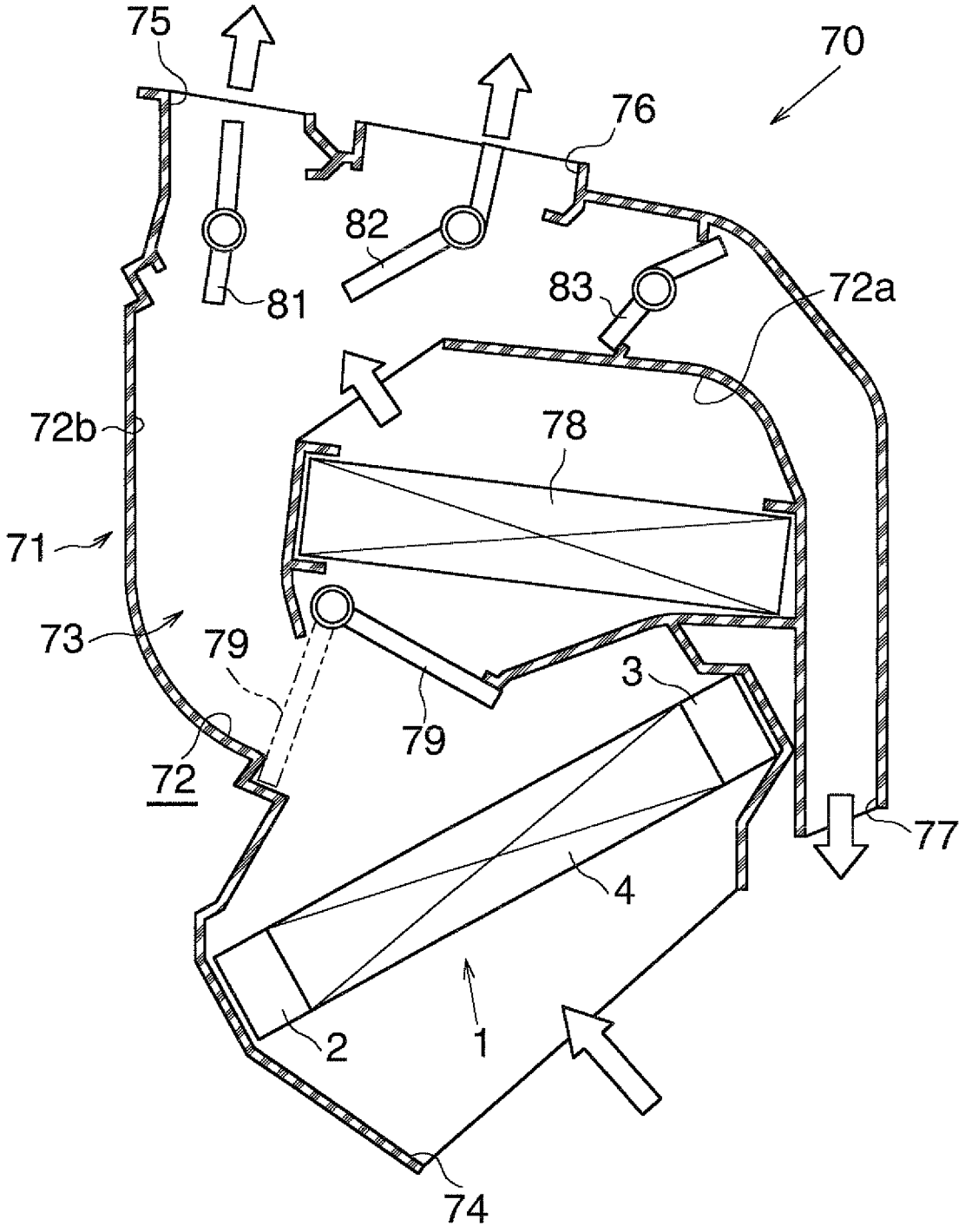
FIG. 8 is a vertical sectional view schematically showing a vehicular air conditioner in which the evaporator of FIG. 1 is used.

The above-described evaporator 1 constitutes a refrigeration cycle in cooperation with a compressor, a condenser (refrigerant cooler), and an expansion valve (pressure reducer); and the refrigeration cycle is mounted on a vehicle (e.g., an automobile) as a vehicular air conditioner as shown in FIG. 8.

In FIG. 8, a vehicular air conditioner 70 includes a casing 71 formed of synthetic resin and having an air flow passage 72; a temperature adjustment section 73 which is provided in the casing 71, which has the evaporator 1, and which adjusts the temperature of air fed into the casing 71; and a blower (not shown) which feeds air into the air flow passage 72 inside the casing 71 and blows out to a vehicle cabin the air whose temperature has been adjusted by the temperature adjustment section 73.

The casing 71 has an air intake opening 74 for receiving the air fed from the blower, a defroster opening 75, a face opening 76, and a foot opening 77. The air intake opening 74, the defroster opening 75, the face opening 76, and the foot opening 77 communicate with one another through the air flow passage 72 provided inside the casing 71. The evaporator 1 is disposed in the air flow passage 72 at a position which is located on the upstream side thereof with respect to the air flow direction and is close to the air intake opening 74. The evaporator 1 is disposed in an inclined state in which the first header tank 2 is located on the lower side in relation to the second header tank 3 as viewed from the outside in the longitudinal direction of the header tanks 2 and 3.

An air heating section 72*a* and a detour section 72*b* for detouring around the air heating section 72*a* are provided in the air flow passage 72 of the casing 71 to be located downstream of the evaporator 1 with respect to the air flow direction. In addition to the evaporator 1, the temperature adjustment section 73 includes a heater core 78 disposed in the air heating section 72*a* of the air flow passage 72 within the casing 71; and an air mix damper 79 which adjusts the ratio between the amount of air which is fed to the heater core 78 of the air heating section 72*a* after passing through the evaporator 1 and the amount of air which is fed to the detour section 72*b* after passing through the evaporator 1 to thereby detour around the heater core 78. The angular position of the air mix damper 79 is properly changed between a first position (see a chain line in FIG. 8) for feeding all the air having passed through the evaporator 1 to the heater core 78 of the air heating section 72*a* and a second position (see a continuous line in FIG. 8) for feeding all the air having passed through the evaporator 1 to the detour section 72*b* to thereby cause the air to detour around the heater core 78. Thus, the ratio between the flow rate of air which passes through the heater core 78 and the flow rate of air which detours around the heater core 78 is adjusted.

Three blowing mode changeover doors 81, 82, and 83 are provided in the air flow passage 72 inside the casing 71 to be located on the downstream side of the air heating section 72*a* and the detour section 72*b* with respect to the air flow direction. These blowing mode changeover doors 81, 82, and 83 perform changeover among a mode in which the air whose temperature has been adjusted by the temperature adjustment section 73 is fed from the defroster opening 75 and is blown out toward the front windshield through a defroster duct (not shown), a mode in which the air whose temperature has been adjusted is fed from the face opening 76 and is blown out toward the head of a vehicle occupant through a face duct (not shown), and a mode in which the air whose temperature has been adjusted is fed from the foot opening 77 and is blown out toward the feet of the vehicle occupant through a foot duct (not shown).

When the vehicle air conditioner 70 is operated, refrigerant having passed through the compressor, the condenser, and the expansion valve flows into the evaporator 1 through the refrigerant inlet 12, flows along the above-described two routes, and flows out of the refrigerant outlet 13. While flowing through the heat exchange tubes 14 of the leeward tube row 15 and the heat exchange tubes 14 of the windward tube row 16, the refrigerant exchanges heat with air flowing through the air-passing clearances of the heat exchange core section 4, whereby the air is cooled. The refrigerant then flows out in vapor phase.

Since the evaporator 1 is disclosed in an inclined state such that the first header tank 2 is located on the lower side in relation to the second header tank 3 as viewed from the outside in the longitudinal direction of the header tanks 2 and 3, due to the influence of gravitational force, the refrigerant having flowed into the lower space 42*b* of the third compartment 42 in the above-described first and second routes becomes more likely to pass through the communication passages 37, flow into the lower space 45*b* of the fourth compartment 45, and flow into the heat exchange tubes 14 of the fourth tube group 16A through the upper space 45*a*, rather than flowing into the heat exchange tubes 14 of the third tube group 15C through the upper space 42*a* of the third compartment 42. However, the total cross sectional area of the circular refrigerant passage holes 52 formed in the split flow control section 58 of the fourth compartment 45 located on the lower side in relation to the third compartment 42 is smaller than the total cross sectional area of the refrigerant passage holes 51 formed in the split flow control section 57 of the third compartment 42, and is preferably 5 to 40% the total cross sectional area of the refrigerant passage holes 51. Therefore, the resistance acting on the flow of refrigerant which flows from the lower space 45*b* of the fourth compartment 45 to the upper space 45*a* thereof through the refrigerant passage holes 52 becomes larger than the resistance acting on the flow of refrigerant which flows from the lower space 42*b* of the third compartment 42 to the upper space 42*a* thereof through the refrigerant passage holes 51. Thus, the amount of refrigerant which flows from the lower space 45*b* of the fourth compartment 45 to the upper space 45*a* thereof is made smaller than the amount of refrigerant which flows from the lower space 42*b* of the third compartment 42 to the upper space 42*a* thereof. Accordingly, balance is established between the amount of refrigerant which flows from the lower space 45*b* of the fourth compartment 45 to the upper space 45*a* thereof and the amount of refrigerant which flows from the lower space 42*b* of the third compartment 42 to the upper space 42*a* thereof, whereby the amount of refrigerant flowing into the heat exchange tubes 14 of the third tube group 15C is made equal to the amount of refrigerant flowing into the heat exchange tubes 14 of the fourth tube group 16A. As a result, the amount of refrigerant flowing into the heat exchange tubes 14 of one of the two tube groups 15C and 16A which are juxtaposed in the air passing direction, constitute the single third path, and are the same in the flow direction of refrigerant in the heat exchange tubes 14 can be made equal to the amount of refrigerant flowing into the heat exchange tubes 14 of the other of the two tube groups 15C and 16A, whereby deterioration of the performance of the evaporator 1 is suppressed.

Figure 9:
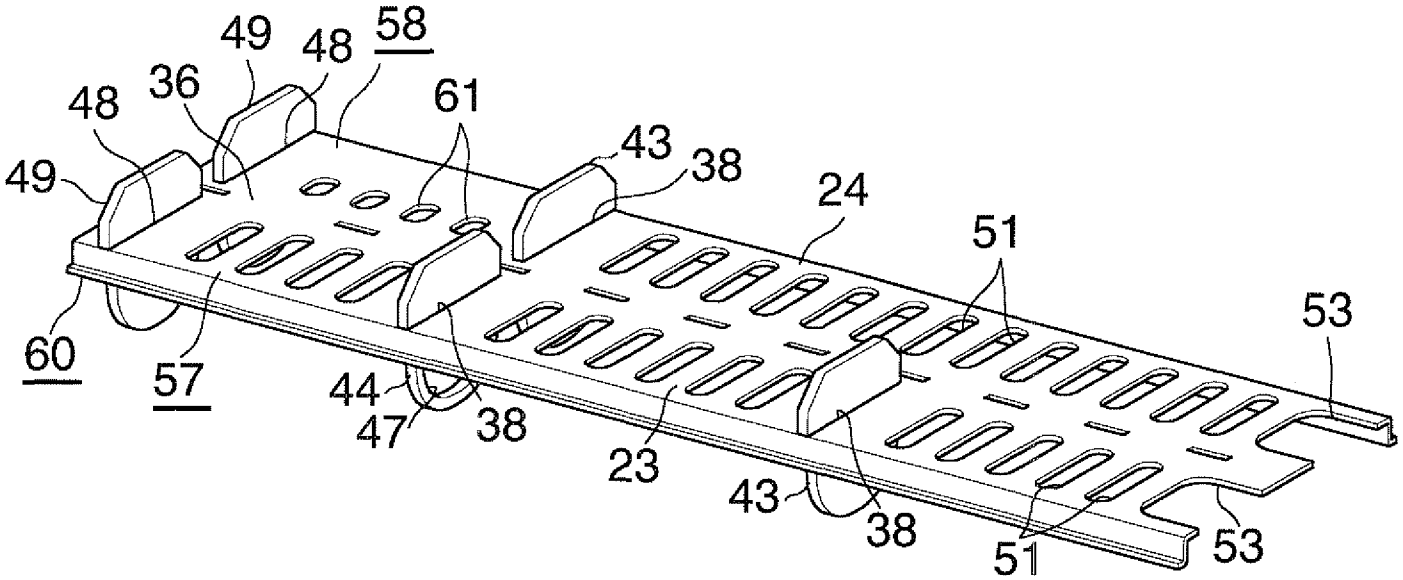
FIG. 9 is a perspective view showing a modification of the third member used in the first header tank of the evaporator of FIG. 1.

FIG. 9 shows a modification of the third member used in the first header tank 2 of the above-described evaporator 1.

In the case of a third member 60 shown in FIG. 9, a plurality of circular refrigerant passage holes 61 are formed in a windward edge portion of the split flow control section 58 such that they are spaced from one another in the left-right direction. The split flow control section 58 is a part of the rear partition portion 24, which part partitions the compartment 45 with which the fourth tube group 16A communicates into the upper and lower spaces 45*a* and 45*b*. In this third member 60 as well, the total cross sectional area of the circular refrigerant passage holes 61 formed in the split flow control section 58 is smaller than the total cross sectional area of the refrigerant passage holes 51 formed in the split flow control section 57 of the third compartment 42, and the total cross sectional area of the former is preferably 5 to 40% the total cross sectional area of the latter.

Figure 4:
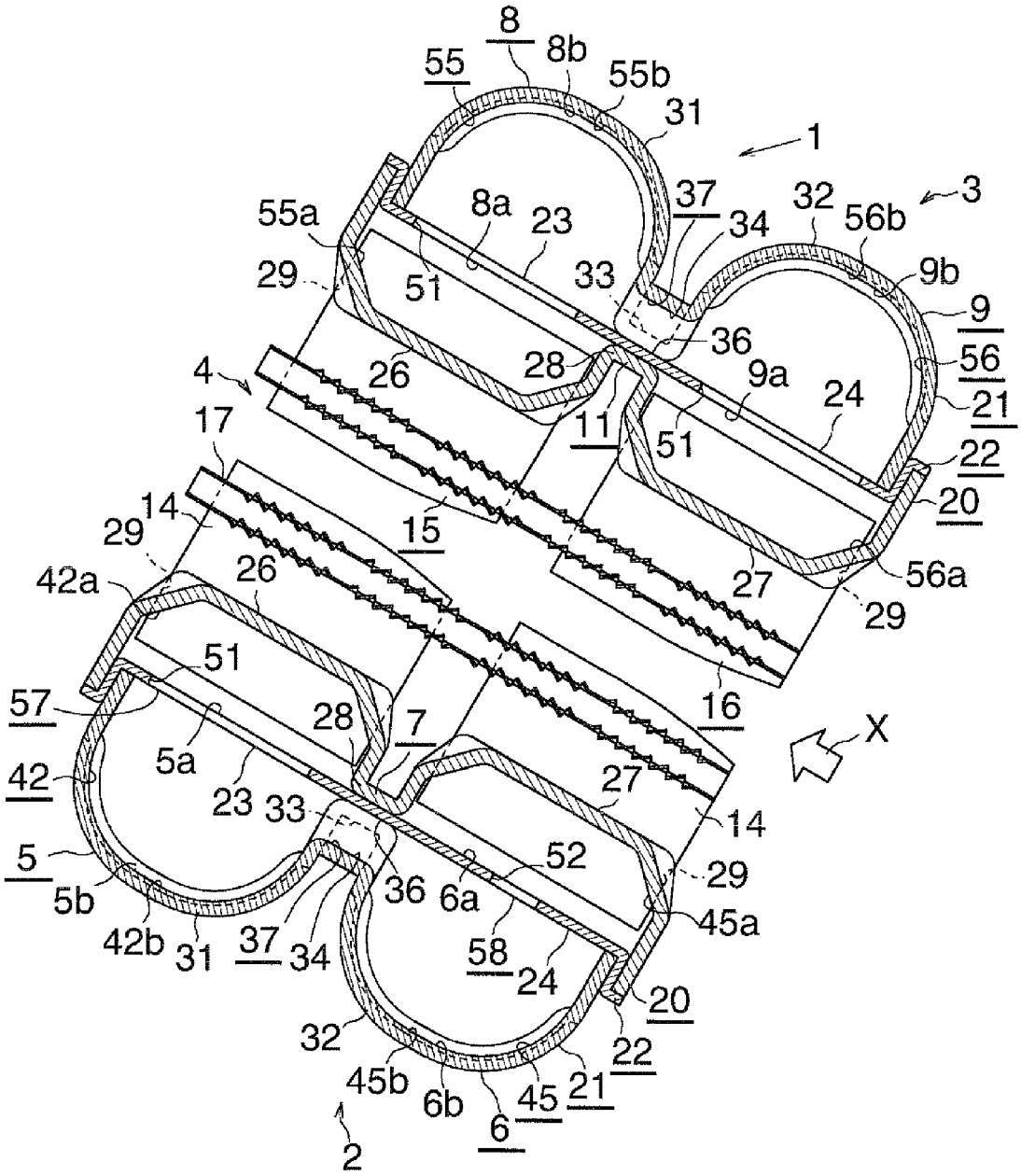
FIG. 4 is a partially omitted sectional view taken along line C-C of FIG. 2.
Figure 5:
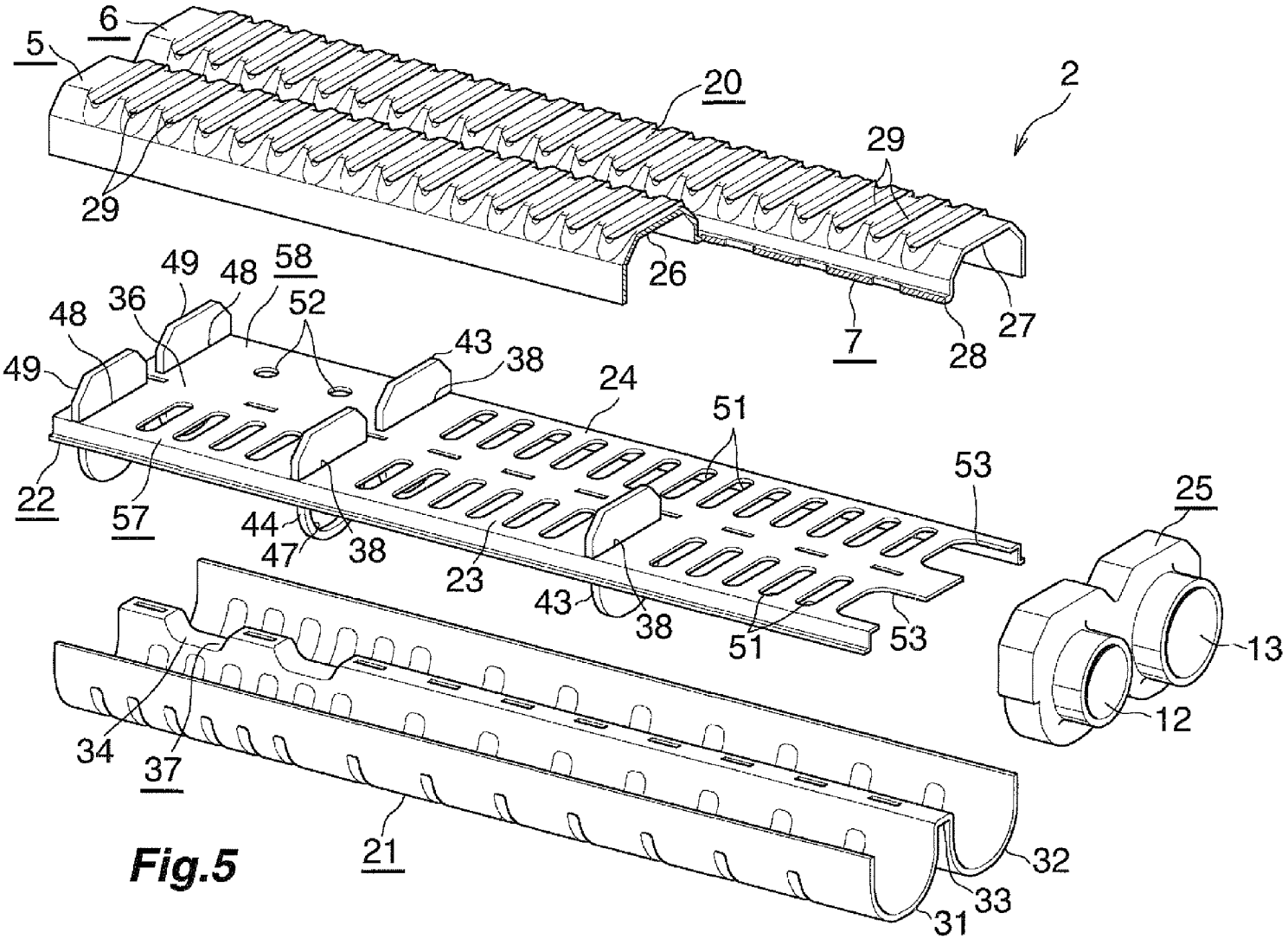
FIG. 5 is an exploded perspective view showing a first header tank of the evaporator of FIG. 1.
Figure 6:
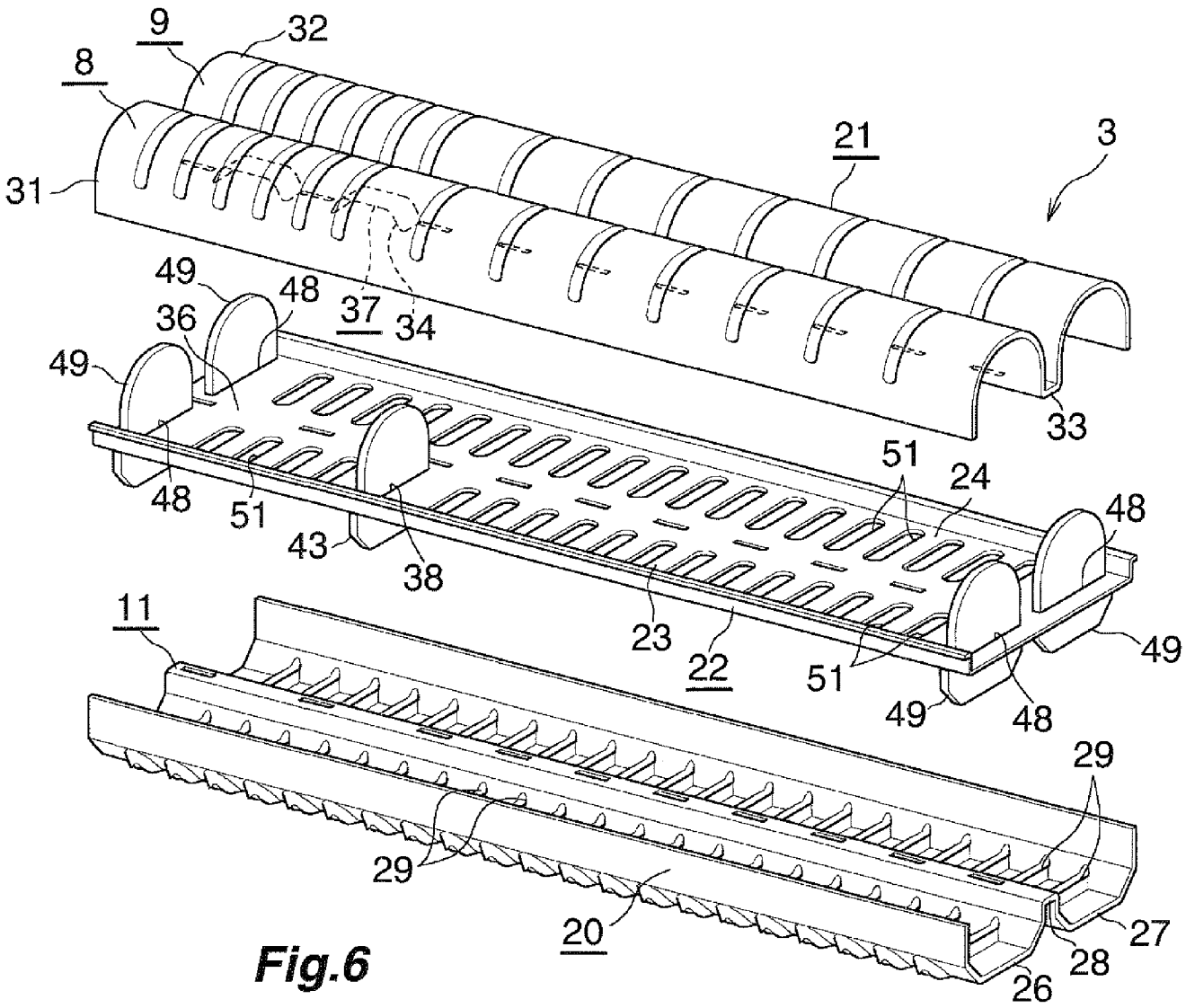
FIG. 6 is an exploded perspective view showing a second header tank of the evaporator of FIG. 1.

The evaporator 1 of the above-described embodiment may be disposed in a state in which the evaporator 1 is inclined in a direction opposite the direction in which the evaporator 1 is inclined in FIG. 4. In this case, since the third compartment 42 is positioned on the lower side in relation to the fourth compartment 45, the plurality of refrigerant passage holes 51 elongated in the front-rear direction are formed in the split flow control section 58 which partitions the fourth compartment 45 into the upper and lower spaces 45*a* and 45*b* such that the refrigerant passage holes 51 are spaced from one another in the left-right direction, and the plurality of circular refrigerant passage holes 52 or 61 are formed in the split flow control section 57 which partitions the third compartment 42 into the upper and lower spaces 42*a* and 42*b* such that the circular refrigerant passage holes 52 or 61 are spaced from one another in the left-right direction. In this case as well, the total cross sectional area of the circular refrigerant passage holes 52 of the split flow control section 57 is made smaller than the total cross sectional area of the refrigerant passage holes 51 formed in the split flow control section 58, and the total cross sectional area of the former is preferably 5 to 40% the total cross sectional area of the latter.

In the above-described embodiment, the refrigerant inlet 12 and the refrigerant outlet 13 are provided on the same header tank. However, their positions are not limited thereto. The refrigerant inlet may be provided on one header tank, and the refrigerant outlet may be provided on the other header tank.

What is claimed is:

1. An evaporator comprising:

a first upper header section;

a first lower header section provided substantially parallel to the first upper header section;

first heat exchange tubes provided between the first upper header section and the first lower header section to connect the first upper header section and the first lower header section, the first heat exchange tubes comprising:

a first tube row which comprises first row heat exchange tubes among the first heat exchange tubes and in which the refrigerant is to flow upward;

a first split flow control section including at least one first hole and provided in the first lower header section to divide an inside of the first lower header section into a first space and a second space which communicates with the first space via the at least one first hole, the second space communicating with the first tube row via the first space which communicates with the first tube row;

a second upper header section provided substantially parallel to the first upper header section;

a second lower header section provided substantially parallel to the first lower header section;

second heat exchange tubes provided between the second upper header section and the second lower header section to connect the second upper header section and the second lower header section, the second heat exchange tubes comprising:

a second tube row comprising second row heat exchange tubes among the second heat exchange tubes and provided opposite to the first tube row, the refrigerant being to flow upward in the second tube row;

a second split flow control section including at least one second hole and provided in the second lower header section to divide an inside of the second lower header section into a third space and a fourth space which communicates with the third space via the at least one second hole, the fourth space communicating with the second tube row via the third space which communicates with the second tube row, the first cross-sectional area of the at least one first hole being smaller than the second cross-sectional area of the at least one second hole; and the evaporator to be placed in an inclined state so that the first lower header section is provided below the second lower header section in a vertical direction.

2. The evaporator according to claim 1, wherein the first upper header section and the first lower header section are provided on a windward side with respect to the second upper header section and the second lower header section.

3. The evaporator according to claim 2, wherein a refrigerant inlet is provided at one end of the second upper header section or the second lower header section.

4. The evaporator according to claim 2, wherein a refrigerant outlet is provided at one end of the first upper header section or the first lower header section.

5. The evaporator according to claim 2, wherein a refrigerant inlet is provided at one end of the second lower header section on a first side and a refrigerant outlet is provided at one end of the first lower header section on the first side.

6. The evaporator according to claim 5, wherein the first tube row and the second tube row are provided on a second side opposite to the first side.

7. The evaporator according to claim 1, wherein the first cross-sectional area is 5% to 40% of the second cross-sectional area.

* * * * *